US007165903B2

(12) United States Patent
Naito

(10) Patent No.: US 7,165,903 B2
(45) Date of Patent: Jan. 23, 2007

(54) PLATEN ROLLER RETAINING STRUCTURE RECORDING APPARATUS

(75) Inventor: Akio Naito, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/374,840

(22) Filed: Mar. 14, 2006

(65) Prior Publication Data

US 2006/0210341 A1 Sep. 21, 2006

(30) Foreign Application Priority Data

Mar. 17, 2005 (JP) ..... 2005-077620

(51) Int. Cl.
*B41J 11/04* (2006.01)

(52) U.S. Cl. ..... 400/660; 400/692; 400/693; 400/120.01

(58) Field of Classification Search ..... 400/660, 400/660.1, 660.2, 660.3, 691, 692, 693, 649, 400/659, 120.01; 384/439
See application file for complete search history.

(56) References Cited

U.S. PATENT DOCUMENTS 4,802,795 A * 2/1989 Takada ..... 400/600
5,032,034 A * 7/1991 Bischof et al. ..... 400/660
5,044,800 A * 9/1991 Rosenthal ..... 400/660

FOREIGN PATENT DOCUMENTS

JP 06071954 A * 3/1994

* cited by examiner

*Primary Examiner*—Leslie J. Evanisko
(74) *Attorney, Agent, or Firm*—Adams & Wilks

(57) ABSTRACT

Provided is a platen roller retaining structure which is small, of a simple construction and easily allows attachment/detachment of a platen roller and which provides a high level of reliability in terms of platen roller retention. A shaft portion (2*a*) of a platen roller (2) is fitted into a connecting portion (3*a*) of a regulating member (3), and the shaft portion (2*a*) and an engagement portion (3*b*) of the regulating member (3) are respectively inserted into a first recess (5) and a second recess (6) of a stationary frame (4), with an outer peripheral portion (2*b*) of the platen roller (2) being held in contact with a thermal head (1) to make recording possible. Escape of the shaft portion (2*a*) from the first recess (5) in direction (A) is prevented by an inner peripheral edge (5*a*). Escape of the shaft portion (2*a*) toward an opening portion (5*b*) in direction (B) without being obstructed by the inner peripheral edge (5*a*) is prevented since the engagement portion (3*b*) abuts an inner peripheral edge (6*a*) and cannot move indirection (B). Removal of the platen roller (2) is possible only when the engagement portion (3*b*) has been caused to escape in direction (C) from the second recess (6), with the shaft portion (2*a*) being kept retained within the first recess (5).

12 Claims, 8 Drawing Sheets

PLATEN ROLLER RETAINING STRUCTURE RECORDING APPARATUS

BACKGROUND OF THE INVENTION

1. Field of the Invention

The present invention relates to a retaining structure for a platen roller used while in contact with a recording head, and a recording apparatus having the retaining structure.

2. Description of the Related Art

Conventionally, there are available recording apparatuses having inside a casing a recording head and a platen roller held in contact therewith, with the recording head performing recording on a recording medium conveyed by the platen roller. In such a recording apparatus, when performing operations, such as the setting of the recording medium, jamming treatment, and maintenance and replacement of the recording head and the platen roller, the operations are very hard to perform when the recording head and the platen roller remain in contact with each other. Accordingly, it is desirable to separate the platen roller and the recording head from each other and expose them to the exterior of the casing. It is desirable for the recording head, which has a plurality of recording elements (e.g., heat generating elements), to be fixed in position inside the casing so as not to impair the reliability of the electrical connection for inputting recording signals for selectively driving the recording elements. In view of this, a construction is generally adopted in which the platen roller is separated from the recording head and extracted to the exterior, with the recording head remaining secured in position inside the casing.

During recording operation, it is necessary for the platen roller to be firmly held in contact with the recording head with a predetermined pressure. Thus, in some constructions, a groove-like recess is provided in the casing, and the platen roller is retained in the recess to thereby effect positioning.

Further, to make the platen roller detachable, a construction is available in which there is provided a spring member, for example, at the opening portion of the recess, that is, at the portion through which the platen roller is let in and out. In this construction, it is possible to elastically deform the spring member and push in the platen roller to a predetermined position in the recess. However, once forcibly brought to the predetermined position, the platen roller cannot be extracted from the recess unless the spring member undergoes elastic deformation again to open the opening portion. When the user applies a force to the spring member to elastically deform the same, the platen roller can be easily removed.

Apart from this, there is a construction in which the shaft portion of the platen roller is retained in the recess by means of a member surrounding the same. That is, at least a part of the opening portion of the recess (entrance portion for platen roller) is blocked to thereby prevent the platen roller from getting out of the recess. The member blocking the opening portion of the recess may be the recording head itself, or a dedicated lock arm for retaining the shaft portion of the platen roller (JP 2000-318260 A). In such a construction, by moving the member surrounding the shaft portion of the platen roller (recording head or lock arm), the opening portion of the recess is opened, and attachment/detachment of the platen roller becomes possible.

JP 2000-118060 A discloses a construction in which a cover plate (cover member) that can be opened and closed with respect to a main body frame (casing base member) is equipped with a first slit into which the shaft portion of the platen roller is inserted, with the main body frame being equipped with a second slit that is to be combined with the first slit to thereby retain the shaft portion of the platen roller when the cover plate is closed. Further, in this construction, a lock lever rotatably provided on the cover plate is engaged with a pin provided on the main body frame, thereby making it possible to fix the cover frame to the main body frame in a state in which the platen roller is retained at the position where the first slit and the second slit join each other.

JP 06-71954 A discloses a construction in which the platen roller has a rotatably mounted bush lever member, and in which a substantially rectangular shaft portion is formed on the bush lever member, with the casing being provided with a recess whose opening portion has a width allowing passage of the shorter side of the rectangular shaft portion but not allowing passage of the longer side thereof. In this construction, the shaft portion of the bush lever member is inserted into the recess, with the shorter side of the substantially rectangular shaft portion being opposed to the opening portion of the recess, and then the bush lever member is rotated by 90 degrees to cause the longer side of the substantially rectangular shaft portion to be opposed to the opening portion of the recess, thereby preventing the shaft portion and the platen roller from getting out of the recess.

Of the above-described conventional examples, the construction in which a spring member is provided at the opening portion of the recess into which the platen roller is inserted, requires provision of an appropriate spring force corresponding to the position and configuration of the spring member. If the spring member does not easily undergo elastic deformation, it is difficult to open the opening portion of the recess, so that the operation of the attachment/detachment of the platen roller is not easy to perform. On the other hand, when the spring member easily undergoes elastic deformation, the spring member may be easily allowed to be elastically deformed by some impact, vibration, etc. even when the user applies no external force thereto, with the result that the platen roller is inadvertently allowed to get out of the recess. It is not easy to accurately realize an appropriate spring force which prevents the platen roller from getting out of the recess during normal recording and which easily allows elastic deformation of the spring member when the user performs attachment/detachment operation. Further, the spring force may change as a result of long-term use, which may lead to a problem regarding the attachment/detachment of the platen roller.

In the construction in which the recording head itself is provided at a position where it blocks the opening portion of the recess to prevent the platen roller from getting out of the recess, there is provided a spring member for pressing the recording head against the platen roller to realize satisfactory recording. As in the above-described construction, this spring member regulates the attachment/detachment of the platen roller. Thus, when the spring member mounted to the recording head is stiff, it is difficult to open the opening portion of the recess, and the operation of attaching/detaching the platen roller is not easy to perform. On the other hand, when the spring member is flexible, the recording head may inadvertently retreat due to some impact, vibration, etc. even when the user applies no external force, with the result that the platen roller is allowed to get out of the recess. It is by no means easy to accurately realize an appropriate spring force which prevents the platen roller from getting out of the recess during normal recording, which can cause the recording head to abut the platen roller with an appropriate pressure, and which, when the user performs attachment/detachment operation, easily allows the spring member to undergo elastic deformation so that the platen roller can be inserted into the recess. Further, the spring force may change as a result of long-term use, which may lead to a problem.

In the construction in which, as disclosed in JP 2000-318260 A, the opening portion of the recess is blocked by a lock arm, the lock arm is usually provided on the base member side of the casing, and is can be moved by an operating lever or the like. That is, the fulcrum for the movement of the lock arm is generally situated in the vicinity of the recording head or at the rear of the recording head. Further, to retain the lock arm at the position where it blocks the opening portion of the recess, there is often provided a spring member to urge the lock arm. Due to the provision of the operating lever, the operability in attachment/detachment ceases to depend solely upon the spring force of the spring member as in the constructions described above. In this construction, however, a fulcrum for the operation of the lock arm, the operating lever, the spring member, etc. are usually arranged on the base member of the casing, in particular, in the vicinity or at the rear of the recording head. As a result, the space in the central portion of the casing is occupied by those members, so it is necessary to separately provide a space for arranging other members related to the various functions of the recording apparatus, and the conveyance route for the recording medium is restricted due to the above-mentioned members, which reduces the degree of freedom in terms of design, and constitutes a hindrance to a reduction in the size of the apparatus as a whole.

The construction as disclosed in JP 2000-118060 A, in which the operating lever is provided not on the main body frame but on the cover frame, is more advantageous than the construction as disclosed in JP 2000-318260 A in that it is possible to effectively utilize the space on the main body frame (casing base member) side. However, this construction, in which the platen is separated from the recording head by moving the entire cover frame, involves a large operational stroke, resulting in a large operating lever. This leads to a reduction in the degree of freedom in terms of installation space for the apparatus. Further, in this construction, in which the platen roller is retained in the first slit, the opening portion (entrance portion) of the first slit is narrowed.

In the construction as disclosed in JP 06-71954 A, the bush lever member, which is relatively large, is rotated by 90 degrees, so a large stroke is involved, and it is necessary to provide a moving space for the bush lever member. Further, the bush lever member is fixed in position, with the platen roller inserted in the recess, so it is necessary to provide a lock portion for the bush lever member and a structure for locking the opening of the casing. Further, it is necessary to strictly maintain the following relationship: the length of the longer side of the substantially rectangular shaft portion> the width of the opening portion of the recess> the length of the shorter side of the shaft portion. If the difference between those dimensions is slight, the reliability in locking deteriorates, so a reduction in size to an extreme degree is impossible.

SUMMARY OF THE INVENTION

The present invention has been made with a view toward solving the problems in the conventional examples described above. It is accordingly an object of the present invention to provide a platen roller retaining structure which is small and of a simple construction, which easily allows attachment/detachment of the platen roller, and which helps to secure high reliability regarding the retention of the platen roller, and a recording apparatus equipped with such a platen roller retaining structure.

A platen roller retaining structure according to the present invention including: a platen roller capable of rotating; a regulating member being a connecting portion mounted to the platen roller and an engagement portion kept at a predetermined distance from the connecting portion and which is capable of relative rotation coaxially with and relative to the platen roller; and a stationary frame having a first recess for retaining the platen roller at a predetermined position opposed to a recording head performing recording on a recording medium, and a second recess for retaining the engagement portion of the regulating member at a predetermined position, is characterized in that a part of an inner peripheral edge of the first recess is located to regulate movement of the platen roller in a particular direction, with the platen roller being retained in the first recess and the engagement portion of the regulating member being retained in the second recess, a part of an inner peripheral edge of the second recess forming an arc whose center is the platen roller is located to regulate movement of the engagement portion in a particular direction, with the platen roller being retained in the first recess and the engagement portion of the regulating member being retained in the second recess, and with the platen roller being retained in the first recess and the engagement portion of the regulating member being retained in the second recess, the regulating member rotates coaxially with and relative to the platen roller while the platen roller remains retained in the first recess without moving, and the engagement portion moves along the inner peripheral edge of the second recess to escape from the second recess to thereby enable the platen roller to move in a direction in which it can escape from the first recess.

With the platen roller being retained in the first recess and the engagement portion of the regulating member being retained in the second recess, a part of the inner peripheral edge of the first recess prevents the platen roller from escaping from the first recess while the engagement portion remains retained in the second recess without moving, and with the platen roller being retained in the first recess and the engagement portion of the regulating member being retained in the second recess, a part of the inner peripheral edge of the second recess prevents escape of the platen roller from the first recess and escape of the engagement portion from the second recess from being simultaneously effected.

In this construction, in the state in which the platen roller is retained in the first recess and in which the engagement portion of the regulating member is retained in the second recess, solitary movement of the platen roller to escape from the first recess, and simultaneous escape of the platen roller and the engagement portion respectively from the first recess and the second recess, are hindered by the inner peripheral edges of the first and second recesses. Thus, if an external force is applied to the platen roller from, for example, the recording head or the recording medium, there is no fear of the platen roller from escaping from the first recess.

When the engagement portion is first allowed to get out of the second recess, it is possible, thereafter, to allow the platen roller to get out of the first recess, so it is possible for the user to intentionally remove the platen roller. There is a relatively high degree of freedom regarding the position and configuration of the engagement portion, and there is a low possibility of its receiving pressure from the recording head, the recording medium, etc., so the possibility of the engagement portion inadvertently escaping from the second recess is low.

In a case where the direction in which the platen roller can escape from the first recess without being regulated by the inner peripheral edge and the direction in which the engagement portion abuts the inner peripheral edge of the second recess coincide with each other, there is provided a high level of reliability for preventing escape of the platen roller and the engagement portion respectively from the first recess and the second recess. Although it depends on the size of the engagement portion and the contact area between it and the inner peripheral edge, it is not always necessary for the above-mentioned two directions to coincide with each other; the desired effect can be obtained when the directions are substantially the same.

The platen roller has a shaft portion retained in the first recess, and the connecting portion of the regulating member may be mounted to the shaft portion so as to be capable of rotation and incapable of detachment. With the shaft portion being supported by a bearing portion, the platen roller may be retained in the first recess integrally with the bearing portion.

The recording apparatus of the present invention has a platen roller retaining structure of one of the above-described structures, and a recording head. The recording head is mounted to a stationary frame, whereas the platen roller and the regulating member are mounted to a platen frame movable with respect to the stationary frame.

It is preferable that an operating lever for rotating the regulating member coaxailly with the platen roller be further provided, and the operating lever be provided movably with respect to the stationary frame and the platen frame. The operating lever causes the engagement portion to escape from the second recess by rotating the regulating member coaxially with the platen roller, enabling the platen roller to escape from the first recess in a direction in which it is not regulated by the inner peripheral edge.

A casing composed of a base member and a cover member capable of being opened and closed with respect to the base member is further provided. The stationary frame may be fixed to the base member, and the platen frame may be fixed to the cover member. An accommodating space capable of accommodating a roll body formed by winding up a recording medium to be supplied to a gap between the recording head and the platen roller, may be formed by the cover member and the base member.

According to the present invention, a state is normally maintained in which the platen roller is retained in the first recess and in which the engagement portion of the regulating member is retained in the second recess. If some external force is applied to the platen roller from, for example, the recording head or the recording medium, it is possible to suppress solitary movement of the platen roller to get out of the first recess and simultaneous escape of the platen roller and the engagement portion respectively from the first recess and the second recess. Thus, there is no fear of the platen roller being inadvertently deviated from the predetermined position where it is held in contact with the recording head. When the engagement portion is first allowed to get out of the second recess, it is possible, thereafter, to allow the platen roller to get out of the first recess, so it is well possible for the user to intentionally remove the platen roller. There is provided a relatively high degree of freedom regarding the position and configuration of the engagement portion so that it will not easily receive an inadvertent external force.

According to the present invention, which does not adopt a construction in which the platen roller is retained while surrounded by other members, such as a spring member and a lock arm, there is little fear of a deterioration in reliability even in the case of long-term use.

DESCRIPTION OF THE PREFERRED EMBODIMENTS

In the following, embodiments of the present invention will be described with reference to the drawings. FIGS. 1 through 6 show a main portion of a platen roller retaining structure according to an embodiment of the present invention.

Figure 1:
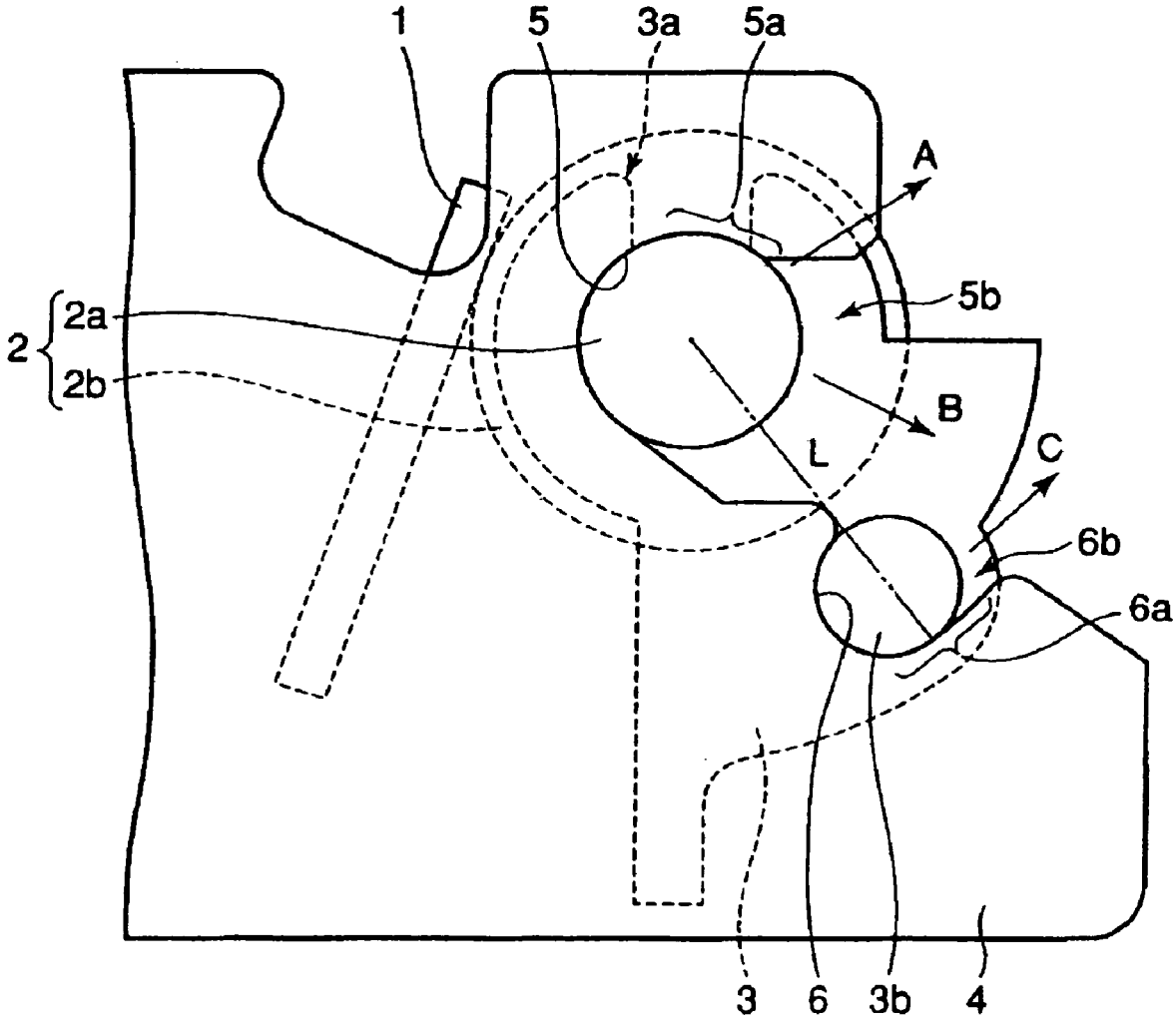
FIG. 1 is a front view of a platen roller retaining structure according to the present invention.
Figure 2:
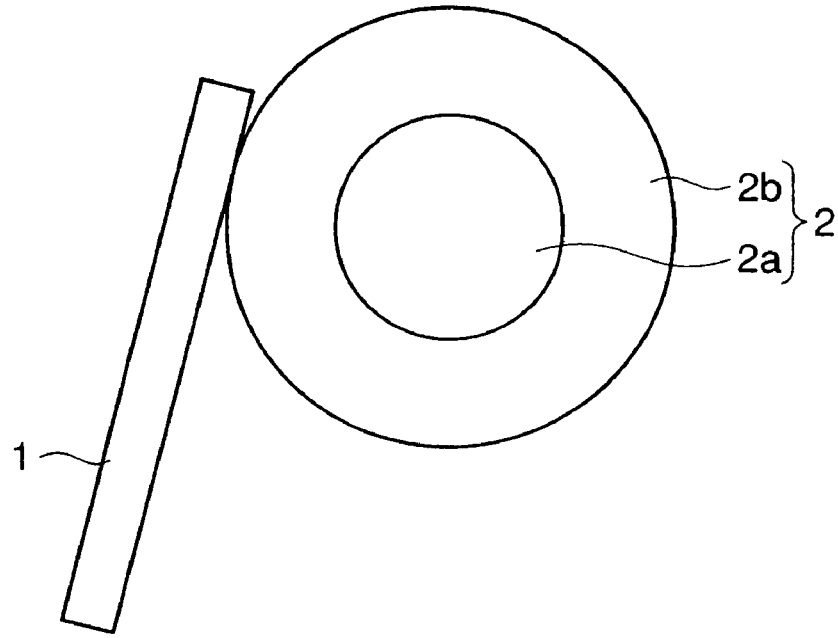
FIG. 2 is a front view of a platen roller and a thermal head in the platen roller retaining structure shown in FIG. 1.

As shown in FIGS. 1 and 2, a thermal head 1, which is an example of a recording head for performing recording on a recording medium (not shown), and a platen roller 2 for conveying the recording medium, are arranged so as to be in contact with each other. Although not shown, the thermal head 1 is provided with a large number of heat generating elements, an electrical connection mechanism for transmitting drive signals for selectively driving the heat generating elements, and a spring member and a pressing member or the like for holding the thermal head 1 in press contact with the platen roller 2. The platen roller 2 has a shaft portion 2*a* and an outer peripheral portion 2*b* formed of an elastic material. The thermal head 1 and the platen roller 2 constitute the recording portion.

Figure 3:
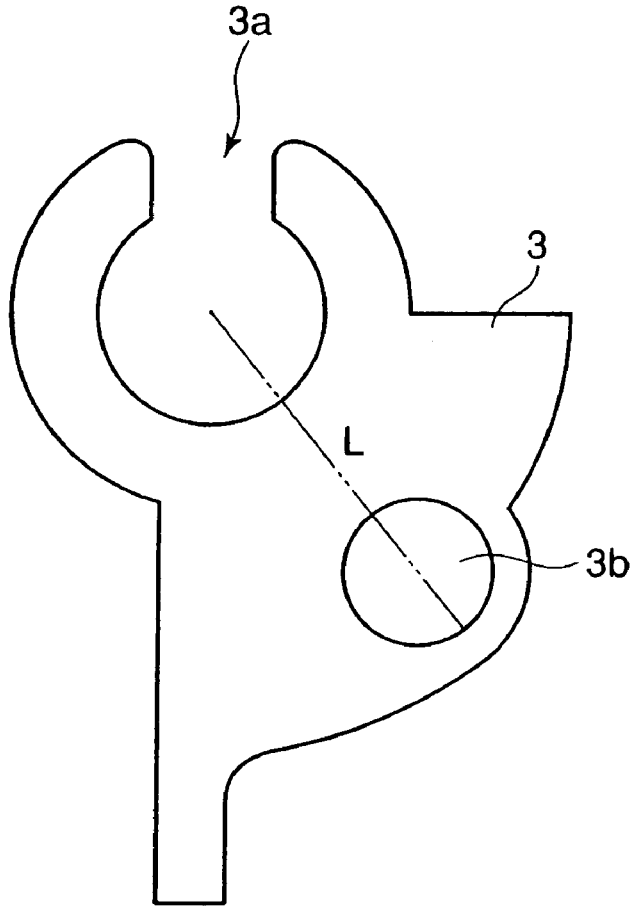
FIG. 3 is a front view of a regulating member in the platen roller retaining structure shown in FIG. 1.
Figure 5:
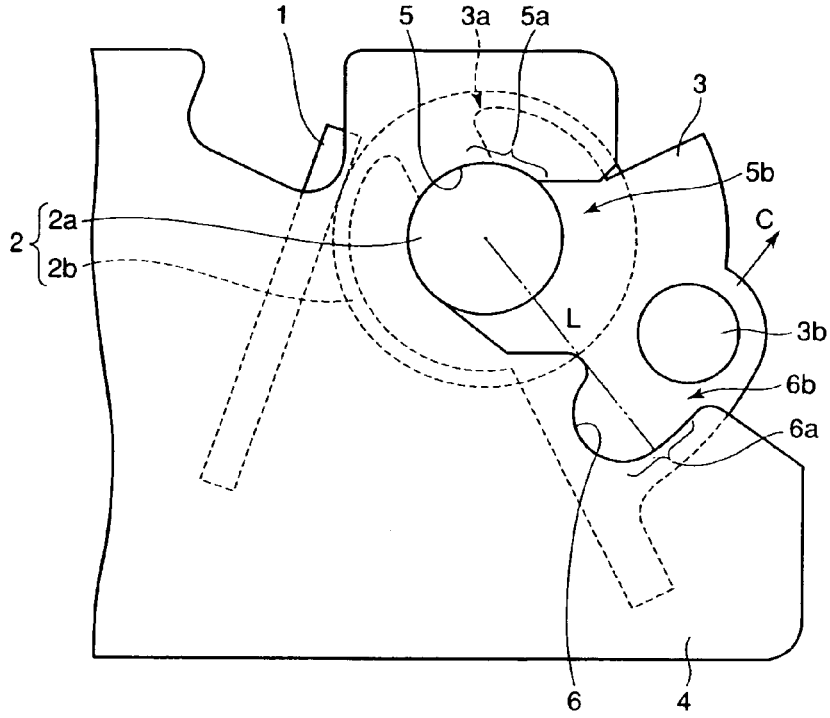
FIG. 5 is a front view showing a first step of a platen roller attachment/detachment process for the platen roller retaining structure shown in FIG. 1.
Figure 6:
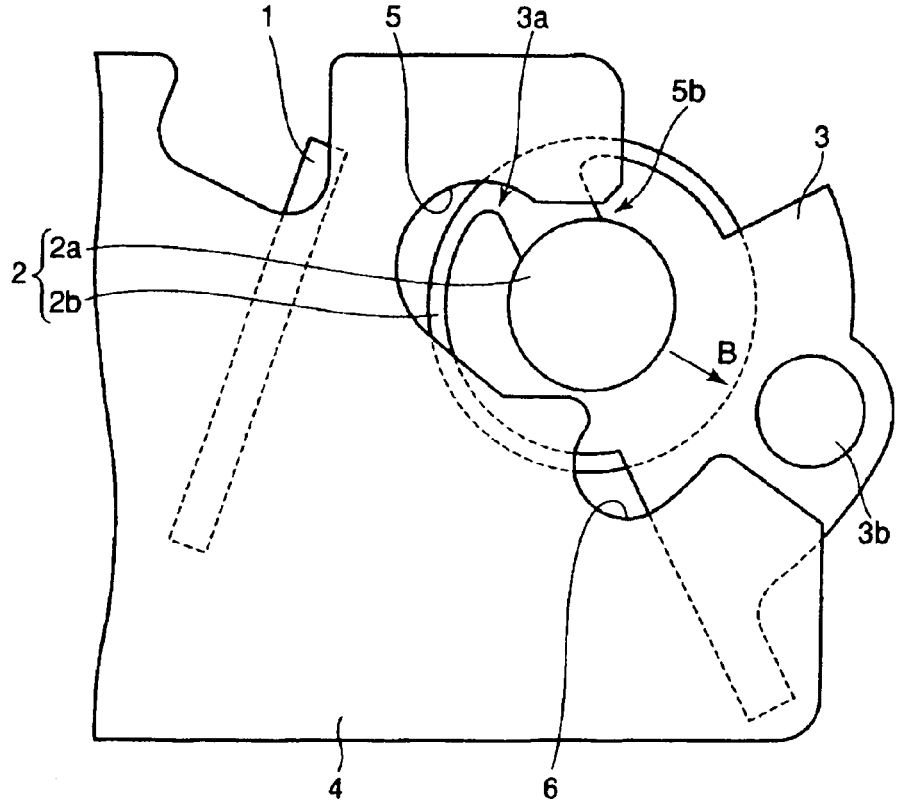
FIG. 6 is a front view showing a second step of the platen roller attachment/detachment process for the platen roller retaining structure shown in FIG. 1.

The shaft portion 2*a* of the platen roller 2 is fitted into a connecting portion 3*a* of a regulating member 3 shown in FIGS. 1 and 3, whereby the regulating member 3 is mounted so as to be coaxial with the platen roller 2 and capable of relative rotation with respect to the platen roller 2. As shown in FIGS. 1, 5, and 6, in the state in which the platen roller 2 and the regulating member 3 have been assembled together, the regulating member 3 is incapable of being detached from the platen roller 2. Thus, while capable of relative rotation, the regulating member 3 and the platen roller 2 move integrally otherwise. The regulating member 3 is equipped with an engagement portion 3*b* in the form of a protrusion. The regulating member 3 has a relatively high level of rigidity and is not easily deformed. The distance L from the center of the connecting portion 3*a* (the center of the platen roller 2 to which the connecting portion 3*a* is mounted) to the outermost edge of the engagement portion 3*b* is constant.

Figure 4:
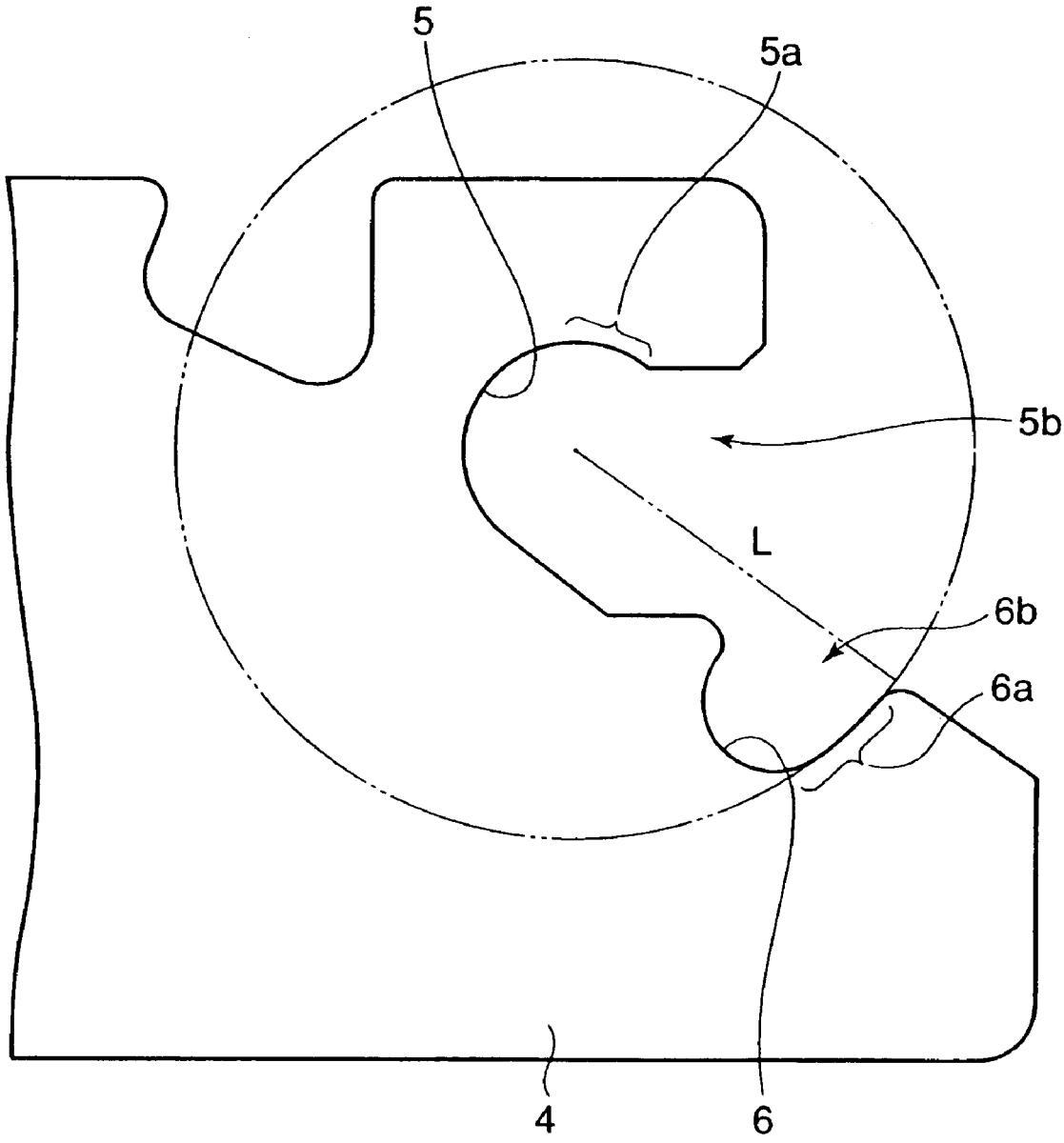
FIG. 4 is a front view of a stationary frame in the platen roller retaining structure shown in FIG. 1.

A stationary frame 4 shown in FIGS. 1 and 4 is fixed to a base member 9 (see FIGS. 7 and 11) of a casing 10 of a recording apparatus so as to be immovable. The stationary frame 4 is provided with a groove-like first recess 5 and a groove-like second recess 6. The first recess 5 serves to retain the platen roller 2 in a stable manner at a predetermined position where the platen roller 2 is held in contact with the thermal head 1 to make it possible to effect satisfactory conveyance and recording. The second recess 6 serves to retain the engagement portion 3*b* of the regulating member 3 at a predetermined position in a stable manner when the platen roller 2 is retained at the predetermined position in the first recess 5, with the platen roller 2 and the regulating member 3 being integrated as described above. A part of an inner peripheral edge 6*a* of the second recess 6 forms an arc whose center is the center of the first recess 5 (the center of the platen roller 2 retained in the first recess 5), and the distance L from the center of the first recess 5 to the inner peripheral edge 6*a* coincides with the distance L from the center of the connecting portion 3*a* of the regulating member 3 to the outermost edge of the engagement portion 3*b*.

The shaft portion 2*a* of the platen roller 2 shown in FIG. 2 is fitted into the connecting portion 3*a* of the regulating member 3 shown in FIG. 3 and is integrated therewith. The shaft portion 2*a* of the platen roller 2 is inserted into the first recess 5 of the stationary frame 4 shown in FIG. 4, and the engagement portion 3*b* of the regulating member 3 is inserted into the second recess 6 of the stationary frame 4, whereby the platen roller retaining structure of this embodiment as shown in FIG. 1 is formed. The thermal head 1 is attached to a head support member 13 (see FIGS. 7 through 11), and the head support member 13 is mounted to the stationary frame 4. The thermal head 1 is not fixed in position with respect to the platen roller 2 and the regulating member 3.

In the state as shown in FIG. 1, the thermal head 1 is held in contact with the outer peripheral portion 2*b* of the platen roller 2 with a predetermined pressure by the spring member and the pressing member (not shown), making it possible to effect conveyance of the recording medium (not shown) and recording thereon in a satisfactory manner. It should be noted, however, that, when performing the operation of inserting and setting the recording medium between the thermal headland the platen roller 2, the operation of resolving jamming of the recording medium (so-called paper jamming) generated between the thermal head 1 and the platen roller 2, the operation of replacing the thermal head 1 and/or the platen roller 2, and maintenance operation, it is desirable for the platen roller 2 to be separated from the thermal head 1 and exposed to the exterior. In view of this, in this embodiment, the platen roller 2 and the regulating member 3, integrated with each other, can be detached from the stationary frame 4. This construction will be described in detail below.

In the state shown in FIG. 1, to separate the platen roller 2 from the thermal head 1, and to detach the platen roller 2 and the regulating member 3 from the stationary frame 4, the following three methods may be considered.

According to the first method, an attempt is to be made to cause the shaft portion 2*a* of the platen roller 2 to escape from the first recess 5, with the engagement portion 3*b* of the regulating member 3 remaining situated within the second recess 6. In this case, the regulating member 3 and the platen roller 2 are to be integrally rotated in the direction indicated by arrow A around the engagement portion 3*b* of the regulating member 3. However, the inner peripheral edge 5*a* of the first recess 5 abuts the shaft portion 2*a* of the platen roller 2 to hinder its rotation. Thus, it is impossible to allow the shaft portion 2*a* of the platen roller 2 to escape from the first recess 5, with the engagement portion 3*b* of the regulating member 3 remaining situated within the second recess 6.

According to the second method, an attempt is to be made to cause the engagement portion 3*b* of the regulating member 3 to escape from the second recess 6 while causing, substantially at the same time, the shaft portion 2*a* of the platen roller 2 to escape from the first recess 5. In this case, the shaft portion 2*a* of the platen roller 2 abuts the inner peripheral edge 5*a* of the first recess 5 as stated above, and its movement in the direction of arrow A is hindered. Thus, to escape from the first recess 5, the shaft portion 2*a* of the platen roller 2 must move toward the opening portion 5*b* of the first recess 5, that is, substantially in the direction of arrow B. However, an attempt to move the shaft portion 2*a* of the platen roller 2 in the direction of arrow B results in the engagement portion 3*b* of the regulating member 3, which is integrated with the platen roller 2, abutting the inner peripheral edge 6*a* of the second recess 6 to thereby hinder its movement. In this way, movement of the engagement portion 3*b* of the regulating member 3 is hindered, which means movement in the direction of arrow B of the shaft portion 2*a* of the platen roller 2, which is integrated with the regulating member 3, is also hindered. That is, the distance between the shaft portion 2*a* of the platen roller 2 and the engagement portion 3*b* of the regulating member 3, which are integrated with each other, is kept constant, and the portion connecting them with each other acts, in a sense, as a prop, so that it is impossible to simultaneously effect escape of the shaft portion 2*a* of the platen roller 2 from the first recess 5 and escape of the engagement portion 3*b* of the regulating member 3 from the second recess 6. This is due to the fact that the direction B in which the shaft portion 2*a* can escape from the first recess 5 without being regulated by the inner peripheral edge 5*a*, and the direction in which the engagement portion 3*b* abuts the inner peripheral edge 6*a* of the second recess 6, coincide with each other, or are substantially the same directions.

According to the third method, an attempt is to be made to first cause the engagement portion 3*b* of the regulating member 3 to escape from the second recess 6, with the shaft portion 2*a* of the platen roller 2 remaining situated within the first recess 5, and then cause the shaft portion 2*a* of the platen roller 2 to escape from the first recess 5. In this case, the regulating member 3 is to be rotated in the direction of arrow C around the shaft portion 2*a* of the platen roller 2. In this process, the engagement portion 3*b* can move freely in the direction of arrow C toward the opening portion 6*b* of the second recess 6 without being hindered at all, and can easily escape from the second recess 6 as shown in FIG. 5. The inner peripheral edge 6*a* of the second recess 6 forms an arc whose center is the shaft portion 2*a* of the platen roller 2 retained within the first recess 5. Further, the distance L from the shaft portion 2*a* of the platen roller 2 to the inner peripheral edge 6*a* of the second recess and the distance L from the shaft portion 2*a* to the outermost edge of the engagement portion 3*b* coincide with each other, so that the escape of the engagement portion 3*b* from the second recess 6 through rotational movement of the regulating member 3 can be effected smoothly and easily. As shown in FIG. 5, after the engagement portion 3*b* of the regulating member 3 has escaped from the second recess 6, the shaft portion 2*a* of the platen roller 2 can move freely in the direction of arrow B. Thus, as shown in FIG. 6, the shaft portion 2*a* is caused to escape to the exterior from the opening portion 5*b* of the first recess 5, and the platen roller 2 and the regulating member 3 are detached from the stationary frame 4, where by the platen roller 2 can be separated from the thermal head 1 and exposed to the exterior.

In this way, in the construction of this embodiment, of the three methods that are to be considered, only the third method, in which the engagement portion 3*b* is first caused to escape from the second recess 6, and then the shaft portion 2*a* of the platen roller 2 is caused to escape from the first recess 5, makes it possible to detach the platen roller 2 and the regulating member 3 from the stationary frame 4. This means that, if some external force, vibration, or impact is applied to the platen roller 2, there is no fear of the platen roller 2 escaping from the first recess 5 to be separated from the thermal head 1. That is, unless the regulating member 3 is rotated around the shaft portion 2*a* of the platen roller 2, the platen roller 2 remains retained within the first recess 5 in a stable manner. The engagement portion 3*b* of the regulating member 3 can be formed at an arbitrary position and in an arbitrary size, so that it can be arranged so as to be as free as possible from external forces. Further, unlike the platen roller 2, it receives no force from the thermal head 1, the recording medium, etc., so that, unless the user intentionally applies a force to the regulating member 3, it is to be assumed that the engagement portion 3*b* will not escape from the second recess 6. For more positive realization of this construction, in this embodiment, the direction in which forces are applied to the platen roller 2 from the thermal head 1, the recording medium, etc. (substantially the same direction as that of arrow B) and the direction in which the engagement portion 3 abuts the inner peripheral edge 6*a* of the second recess 6 to be hindered in its movement, substantially coincide with each other.

In this way, in this embodiment, in the direction A, in which the shaft portion 2*a* of the platen roller 2*a* would escape, with the engagement portion 3*b* remaining retained in the second recess 6, the inner peripheral edge 5*a* of the first recess 5 is situated and hinders its movement in that direction. Further, movement of the shaft portion 2*a* of the platen roller 2 in the direction B toward the opening portion 5*b* without being hindered by the inner peripheral edge 5*a* of the first recess 5, is hindered since the inner peripheral edge 6*a* of the second recess 6 abuts the engagement portion 3*b* to hinder any movement of the engagement portion 3*b* in the direction B. Further, if a force in the direction of arrow C is applied to the platen roller 2, movement of the shaft portion 2*a* is hindered by the inner peripheral edge 5*a* of the first recess 5, so that it is impossible to simultaneously effect the escape of the shaft portion 2*a* from the first recess 5 in the direction of arrow C and the escape of the engagement portion 3*b* from the second recess 6. In this way, there is provided a lock mechanism of high reliability, of a very simple construction and easy to operate in which detachment of the platen roller 2 is possible only by causing the engagement portion 3*b* to move to escape from the second recess 6, with the shaft portion 2*a* of the platen roller 2 remaining retained in the first recess 5.

In the conventional constructions as disclosed in JP 2000-318260 A, JP 2000-118060 A, JP 06-71954 A, etc., after inserting the shaft portion of the platen roller into the recess, the opening portion of the recess is completely blocked by a member, such as a lock arm, or the gap of the opening portion is made narrower than the shaft portion of the platen roller to thereby hinder passage of the shaft portion. In these constructions, a member such as a lock arm, holds the shaft portion, so that, if the lock arm or the like is unstable, the positional accuracy of the platen roller deteriorates, which leads to a deterioration in accuracy in the conveyance of the recording medium and in recording. Further, since the lock arm is a member that is repeatedly moved, it may begin to rattle or deteriorate in operational precision as a result of long-term use and degeneration in its reliability in retaining the platen roller.

In contrast, in the construction of this embodiment, the opening portion 5*b* of the first recess 5 is not blocked, and it is possible to retain the shaft portion 2*a* at a predetermined position in a stable manner, even with a gap allowing passage of the shaft portion 2*a* being left open. Similarly, although the opening portion 6*b* of the second recess 6 is not blocked, and a gap allowing passage of the engagement portion 3*b* is left open, the engagement portion 3*b* is retained in a stable manner. Since it is possible to retain the shaft portion 2*a* in a stable manner without holding it by a member, such as a lock arm, the construction is free from the influence of deterioration in precision of other members, such as a lock arm. The stationary frame 4 is not a moving member like a lock arm and does not deteriorate in precision after long-term use. Further, the distance L from the center of the connecting portion 3*a* of the regulating member 3 acting like a prop (the center of the platen roller 2 to which the connecting portion 3*a* is mounted) to the outermost edge of the engagement portion 3*b* is kept constant, so that the reliability of this embodiment in retaining the platen roller 2 is kept at a high level.

FIGS. 7 through 11 show a recording apparatus adopting the platen roller retaining structure described above. This recording apparatus has a casing 10 composed of a base member (stationary portion) 9 and a cover member (rotatable casing portion) 7 connected so as to be rotatable (capable of opening/closing) around a rotation fulcrum 8. In the lower portion of the casing 10, there is provided an accommodating space 12 for accommodating a roll body 11 (see FIG. 11) formed by winding up a recording medium. In the upper portion of the casing 10, there are provided a platen roller retaining structure according to the present invention as described above including the platen roller 2 serving as a conveyance mechanism for conveying the recording medium paid out of the roll body 11 in the accommodating space 12, the thermal head 1, and mechanical components, electrical components, etc. (not described in detail) for realizing various functions of this recording apparatus.

Figure 8:
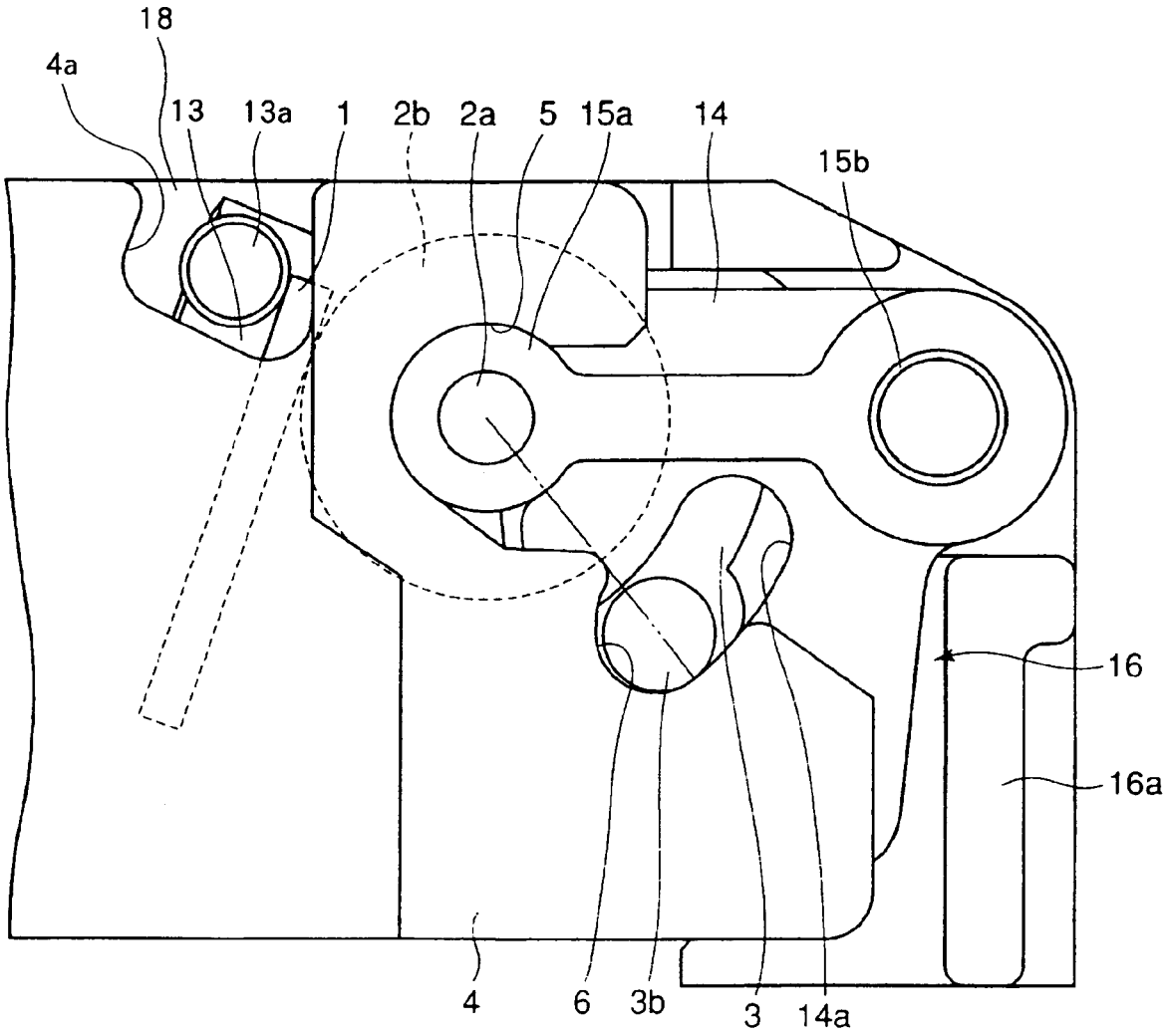
FIG. 8 is an enlarged view showing a main portion of the recording apparatus shown in FIG. 7.

As shown in FIG. 8, which is an enlarged view, the head support member 13 to which the thermal head 1 is attached is mounted to the stationary frame 4 of this embodiment, and the stationary frame 4 is fixed to the base member 9. While supporting the thermal head 1, the head support member 13 can be moved by a pressing member (not shown) so as to bring the thermal head 1 into press contact with the platen roller 2. However, the head support member 13 has a cylindrical portion 13*a* situated in a groove portion 4*a* of the stationary frame, whereby the rotational movement of the thermal head 1 and of the head support member 13 is regulated to prevent them from rotating to an excessive degree.

A platen frame 16 is mounted to the cover member 7, and a bearing member 14 is mounted to the platen frame 16 so as to be rotatable around a cylindrical portion 15*b*. An end portion of the shaft portion 2*a* of the platen roller 2 is supported by a bearing portion 15*a* of the bearing member 14. Thus, the platen roller 2 and the regulating member 3 mounted thereto are incorporated into the platen frame 16 through the intermediation of the bearing member 14. The rotatable range for the bearing member 14, in which the platen roller 2 and the regulating member 3 are incorporated, is regulated by a rotation regulating portion 16*a*, and the rotatable range for the regulating member 3 is regulated by a guide groove 14*a*, into which the engagement portion 3*b* is inserted. In this way, the platen roller 2, the regulating member 3, and the bearing member 14 are mounted to the cover member 7 through the intermediation of the platen frame 16. For the sake of convenience, the platen frame 16 mounted to the cover member 7, and the members mounted thereto (the platen roller 2, the regulating member 3, the bearing member 14, an operating lever 17 described below, etc.) will be generally referred to as a platen unit. On the other hand, the stationary frame 4 (also referred to as the printer main frame) mounted to the base member 9, and the members mounted thereto (the thermal head 1, the head support member 13, the pressing member (not shown), a gear cover 18 (see FIGS. 9 and 10) protecting a printer driving gear row (not shown), etc.) will be generally referred to as a printer main unit. In this embodiment, the printer main unit and the platen unit are joined together with the platen roller retaining structure described above.

In the construction shown in FIGS. 7 through 11, the bearing portion 15*a* is inserted in the first recess 5 of the stationary frame 4. It should be noted, however, that the shaft portion 2*a* of the platen roller 2 is fit-engaged with the bearing portion 15*a* so as to be substantially integrated therewith, so that this construction is to be regarded as completely identical with the construction in which the shaft portion 2*a* is directly inserted into the first recess 5 as shown in FIG. 1.

Further, added to the platen frame 16 are the operating lever 17 (see FIGS. 9 and 10) connected to the regulating member 3 and partially exposed on the outer surface of the cover member 7 and serving to rotate the regulating member 3, a spring member (not shown) for urging the operating lever 17, etc.

As described above, of the above-mentioned components, the printer main unit (the stationary frame 4, the thermal head 1, the head support member 13, the various mechanical and electrical parts, etc.) is fixed to the base member 9. On the other hand, the platen unit (the platen roller 2, the regulating member 3, the bearing member 14, the platen frame 16, the operating lever 17, etc.) is fixed to the cover member 7.

Figure 7:
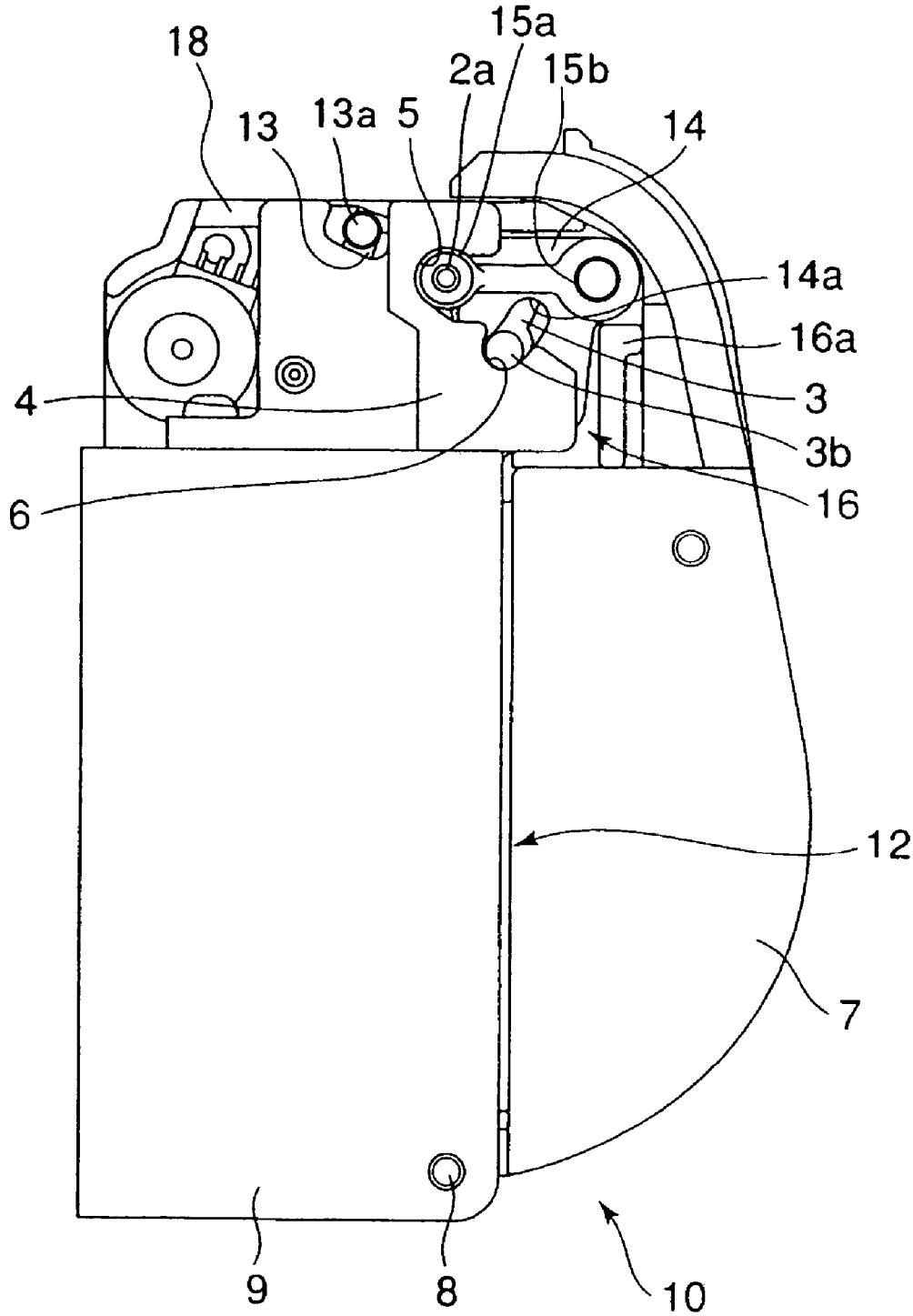
FIG. 7 is a front view of a recording apparatus equipped with the platen roller retaining structure shown in FIG. 1.
Figure 9:
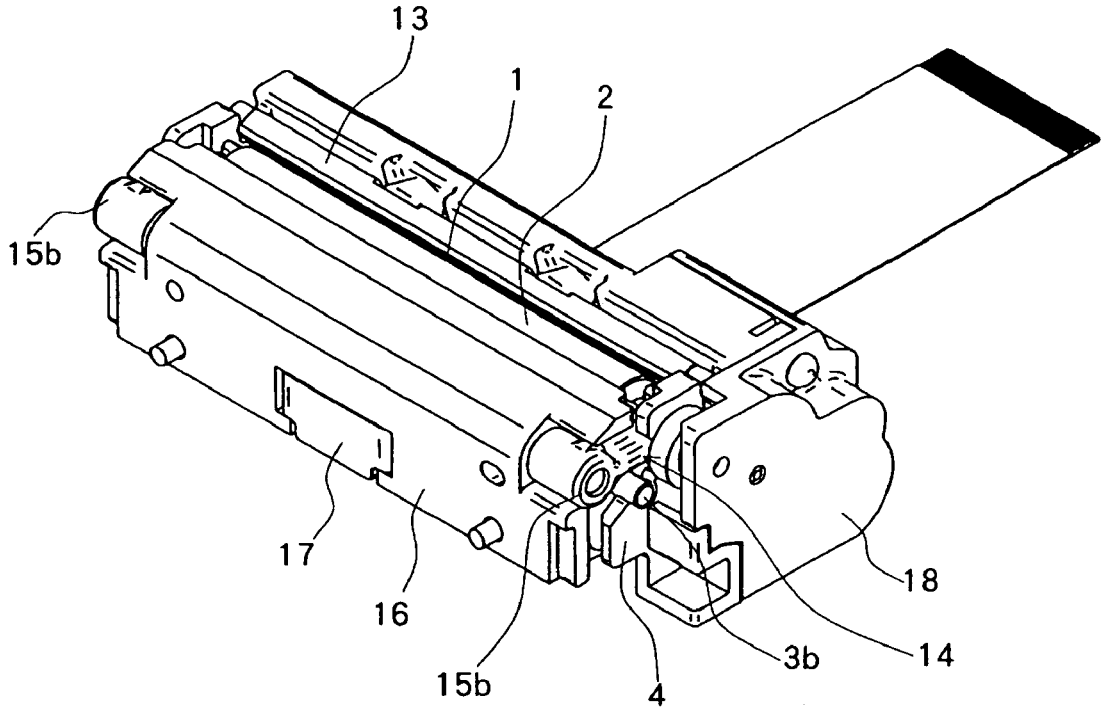
FIG. 9 is a perspective view showing a main portion of the recording apparatus shown in FIG. 7 with the casing thereof omitted.

As in the case of FIG. 1, in this recording apparatus, with the cover member 7 being closed as shown in FIGS. 7 through 9, the shaft portion 2*a* of the platen roller 2 is retained in the first recess 5 of the stationary frame 4, and the engagement portion 3*b* of the regulating member 3 is retained in the second recess 6. The thermal head 1 is held in press contact with the outer peripheral portion 2*b* of the platen roller 2, and the recording medium paid out of the roll body 11 is inserted between the thermal head 1 and the outer peripheral portion 2*b* of the platen roller 2, making it possible to perform conveyance and recording in a satisfactory manner. The operating lever 17 is urged by the spring member, whereby the engagement portion 3*b* is pushed into the depth of the second recess 6.

Figure 10:
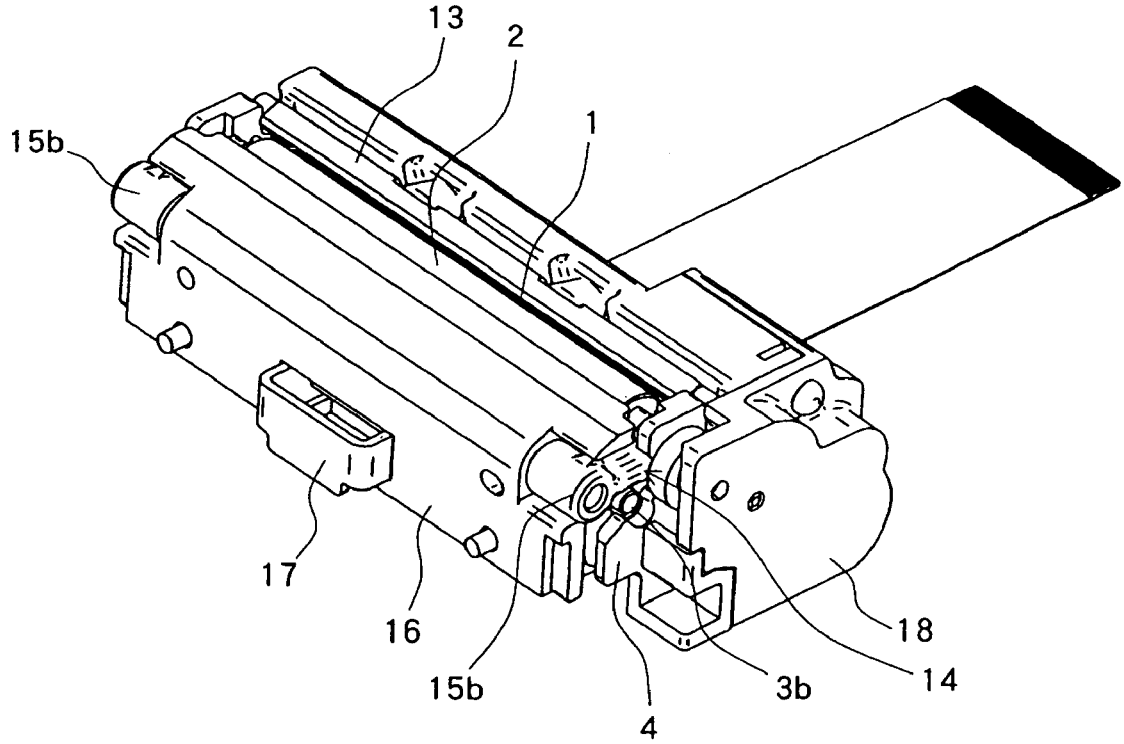
FIG. 10 is a perspective view showing a main portion of the recording apparatus shown in FIG. 7 with the casing thereof omitted, illustrating the operation of opening a cover member.
Figure 11:
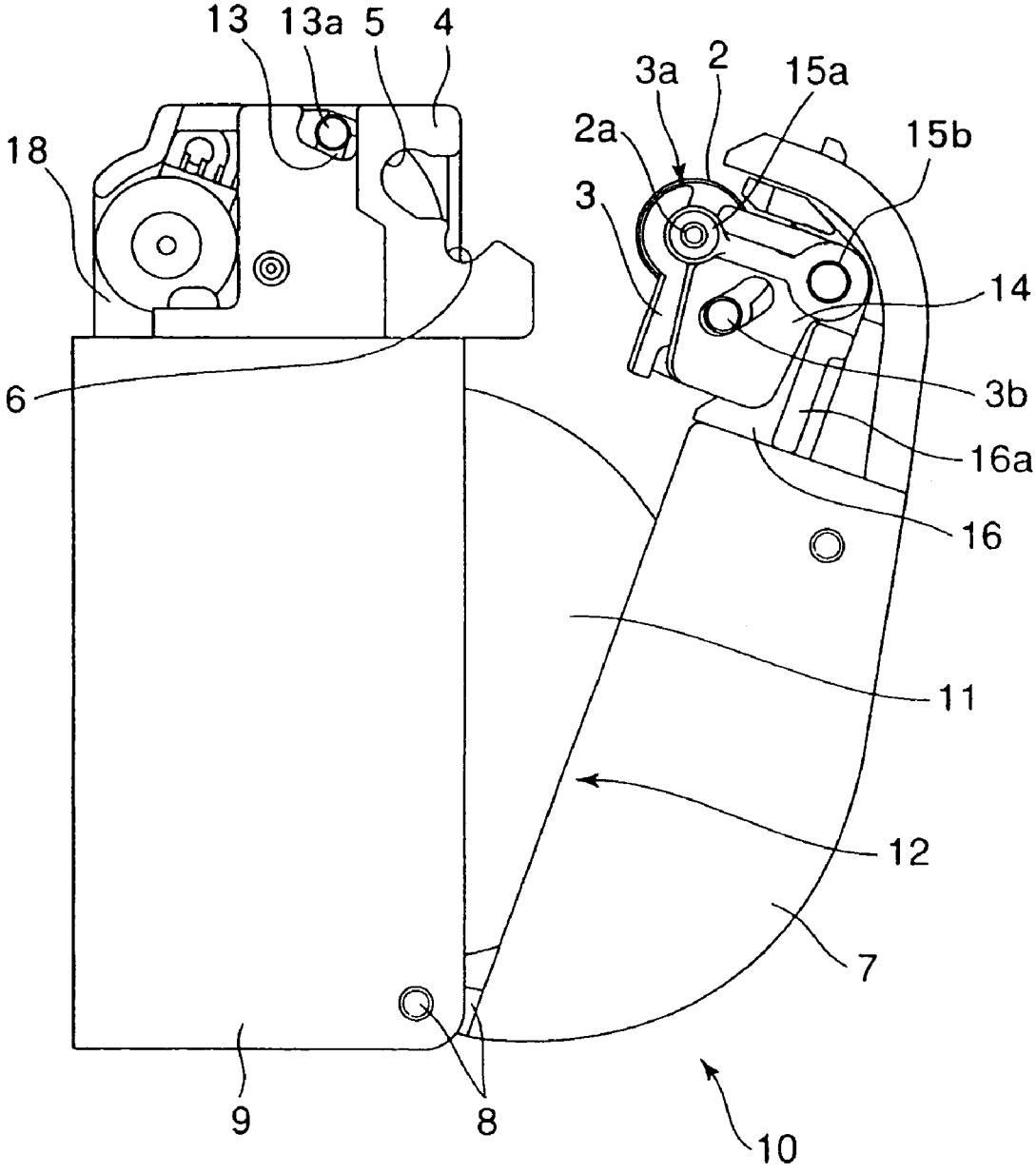
FIG. 11 is a front view of the recording apparatus shown in FIG. 7 with the cover member open.

When the cover member 7 is to be opened by the user, the operating lever 17 is first displaced and the regulating member 3 is rotated as shown in FIG. 10 against the urging force of the spring member, causing the engagement portion 3*b* to escape from the second recess 6 as in the case of FIG. 5. Then, while rotating the cover member 7 around the rotation fulcrum 8 to open it with respect to the base member 9 as shown in FIG. 11, the shaft portion 2*a* of the platen roller 2 is caused to escape from the first recess 5. In this state, it is possible to easily perform replenishment or replacement of the roll body 11, setting of the recording medium, resolution of paper jamming, replacement of the thermal head 1 and/or the platen roller 2, maintenance, etc. The platen unit detached from the stationary frame 4 is supported by the cover member 7. In this construction, on the base member 9 side of the upper portion of the casing 10, there are arranged no members related to the attachment/detachment of the platen roller 2, such as the operating lever 17 and the spring member urging the operating lever 17, and these members are arranged on the cover member 7 side. Thus, on the base member 9 side, it is possible to freely arrange components related to various functions other than the attachment/detachment of the platen roller 2, thus making it possible to utilize the space efficiently. Further, the stroke of the operating lever 17 is small enough not to cause it to protrude on the base member 9 side, so that there is no need to prepare a large space in order to provide the movement path for the operating lever 17.

When restoring the cover member 7 from the open state shown in FIG. 11 to the closed state shown in FIGS. 7 through 9, after the shaft portion 2*a* of the platen roller 2 is inserted into the first recess 5, and the engagement portion 3*b* of the regulating member 3 is inserted into the second recess 6. The platen roller 2 and the regulating member 3 are rotatable around the cylindrical portion 15*b* of the bearing member 14 with respect to the platen frame 16, and the regulating member 3 is rotatable around the connecting portion 3*a* and the platen roller 2, so that the bearing portion 15*a* and the shaft portion 2*a* of the platen roller 2 are inserted into the first recess 5, and the engagement portion 3*b* is inserted into the second recess 6 while shifting the positions of the shaft portion 2*a* and the engagement portion 3*b*, that is, while moving the bearing portion 15*a* moving vertically with respect to the platen frame 16 and the stationary frame 4. As the bearing of the platen roller 2, the bearing member 14 serves to perform positioning on the center of the platen roller 2 with respect to the first recess 5, and serves as a link mechanism for moving the center of the platen roller 2 vertically with respect to the platen frame 16. Due to this construction, solely through the rotational movement of the cover member 7 and the platen frame 16 around the rotation fulcrum 8, the bearing portion 15*a* and the shaft portion 2*a* of the platen roller 2 and the engagement portion 3*b* can be inserted into the first and second recesses 5 and 6, respectively.

When there is provided an urging member for pushing the engagement portion 3*b* into the second recess 6, such as the spring member urging the operating lever 17, it is possible to achieve an improvement in terms of reliability in retaining the platen roller 2 (reliability in the locking). However, such an urging member need not exist as long as it is possible to push the engagement portion 3*b* into the second recess 6 as needed.

While in the recording apparatus described above the printer main unit and the platen unit are accommodated in the casing 10, the apparatus can function as a recording apparatus capable of conveyance of a recording medium and recording even in a state in which the printer main unit and the platen unit are not accommodated in the casing 10 as shown in FIGS. 9 and 10. Thus, the recording apparatus of the present invention can be used in a state in which it is not accommodated in the casing 10, or in a state in which it is accommodated in some other container or the like. Further, it is also possible to integrate the stationary frame 4 with the base member 9 of the casing 10, and to integrate the printer frame 16 with the cover member 7 of the casing 10.

While the operating lever 17 may be of a construction in which a part (operating portion) thereof can be exposed to the exterior as described above, it may also be of a construction in which it is connected to another member mounted to the casing 10 and is moved by that member. Further, the operating lever 17 may be directly connected to the regulating member 3, or indirectly through the intermediation of some other member. In either case, the operating lever 17 constitutes a mechanism for rotating the regulating member 3 through operation by the user from the exterior of the casing 10. Further, the operating lever 17 may also be mounted to the base member 9 side instead of being mounted to the cover member 7 side. In that case, however, it is desirable to add a mechanism which connects the operating lever 17 and the regulating member 3, with the cover member 7 being closed, and which cancels their connection, with the cover member 7 being open.

What is claimed is:

1. A platen roller retaining structure comprising:

a platen roller capable of rotating;

a regulating member having a connecting portion mounted to the platen roller and an engagement portion kept at a predetermined distance from the connecting portion and which is capable of relative rotation coaxially with and with relative to the platen roller; and a stationary frame having a first recess for retaining the platen roller at a predetermined position opposed to a recording head performing recording on a recording medium, and a second recess for retaining the engagement portion of the regulating member at a predetermined position, wherein:

a part of an inner peripheral edge of the first recess is located in a position where the part of the inner peripheral edge of the first recess regulates movement of the platen roller in a particular direction, with the platen roller being retained in the first recess and the engagement portion of the regulating member being retained in the second recess;

a part of an inner peripheral edge of the second recess forming an arc whose center is the platen roller is located in a position where the part of the inner peripheral edge of the second recess regulates movement of the engagement portion in a particular direction, with the platen roller being retained in the first recess and the engagement portion of the regulating member being retained in the second recess; and with the platen roller being retained in the first recess and the engagement portion of the regulating member being retained in the second recess, the regulating member rotates coaxially with and relative to the platen roller while the platen roller remains retained in the first recess without moving, and the engagement portion moves along the inner peripheral edge of the second recess to escape from the second recess to thereby enable the platen roller to move in a direction in which the platen roller can escape from the first recess.

2. A platen roller retaining structure according to claim 1, wherein:

with the platen roller being retained in the first recess and the engagement portion of the regulating member being retained in the second recess, a part of the inner peripheral edge of the first recess prevents the platen roller from escaping from the first recess while the engagement portion remains retained in the second recess without moving; and with the platen roller being retained in the first recess and the engagement portion of the regulating member being retained in the second recess, a part of the inner peripheral edge of the second recess prevents escape of the platen roller from the first recess and escape of the engagement portion from the second recess from being simultaneously effected.

3. A platen roller retaining structure according to claim 1, wherein the direction in which the platen roller can escape from the first recess without being regulated by the inner peripheral edge of the first recess and a direction it which the engagement portion of the regulating member abuts the inner peripheral edge of the second recess coincide with each other.

4. A platen roller retaining structure according to claim 1, wherein: the platen roller has a shaft portion retained in the first recess; and the connecting portion of the regulating member is mounted to the shaft portion in a manner that the connecting portion of the regulating member is capable of rotation and incapable of detachment.

5. A platen roller retaining structure according to claim 4, wherein, with the shaft portion being supported by a bearing portion, the platen roller is retained in the first recess integrally with the bearing portion.

6. A platen roller retaining structure according to claim 1, further comprising an operating lever for rotating the regulating member coaxially with the platen roller.

7. A platen roller retaining structure according to claim 6, wherein the operating lever causes the engagement portion to escape from the second recess by rotating the regulating member coaxially with the platen roller, enabling the platen roller to escape from the first recess in a direction in which the platen roller is not regulated by the inner peripheral edge of the first recess.

8. A recording apparatus comprising: the platen roller retaining structure as claimed in claim 1; and the recording head, wherein: the recording head is mounted to the stationary frame; and the platen roller and the regulating member are mounted to a platen frame movable with respect to the stationary frame.

9. A recording apparatus according to claim 8, wherein an operating lever for rotating the regulating member coaxially with the platen roller is mounted in a manner that the operating lever is movable with respect to the stationary frame and the platen frame.

10. A recording apparatus according to claim 9, wherein the operating lever causes the engagement portion to escape from the second recess by rotating the regulating member coaxially with the platen roller, and then enables the platen roller to escape from the first recess in a direction in which the platen roller is not regulated by the inner peripheral edge of the first recess.

11. A recording apparatus according to claim 8, further comprising: a casing composed of a base member; and a cover member capable of being opened and closed with respect to the base member, wherein: the stationary frame is fixed to the base member; and the platen frame is fixed to the cover member.

12. A recording apparatus according to claim 11, wherein the cover member and the base member forms an accommodating space capable of accommodating a roll body formed by winding up a recording medium to be supplied to a gap between the recording head and the platen roller.

* * * * *